United States Patent [19]

Kaufman, Jr.

[11] 4,056,950

[45] Nov. 8, 1977

[54] FOOD PROCESSOR WITH AN AIR BALANCING SYSTEM

[75] Inventor: Harold B. Kaufman, Jr., New York, N.Y.

[73] Assignee: DCA Food Industries, Inc., New York, N.Y.

[21] Appl. No.: 689,737

[22] Filed: May 25, 1976

[51] Int. Cl.[2] ..... F25D 25/02

[52] U.S. Cl. ..... 62/381; 62/266

[58] Field of Search ..... 62/63, 265, 266, 378, 62/380, 381; 34/242; 432/242; 98/36

[56] References Cited

U.S. PATENT DOCUMENTS

| | | | |
|---|---|---|---|
| 2,949,747 | 8/1960 | Gregor | 62/380 |
| 3,533,245 | 10/1970 | Komberec et al. | 62/266 |
| 3,600,901 | 8/1971 | Wagner | 62/380 |
| 3,638,451 | 2/1972 | Brandt | 62/381 |
| 3,728,869 | 4/1973 | Schmidt | 62/380 |

*Primary Examiner*—Ronald C. Capossela
*Attorney, Agent, or Firm*—Amster & Rothstein

[57] ABSTRACT

A food processing plant includes a blast freezing chamber through which food products are continuously conveyed having food product entry and exit ports and an air balancing system associated with the food product entry and exit ports to reduce substantially the flow of warm humid air into the blast freezing chamber and reduce substantially the flow of refrigerated air out of the chamber.

14 Claims, 4 Drawing Figures

FIG. 1
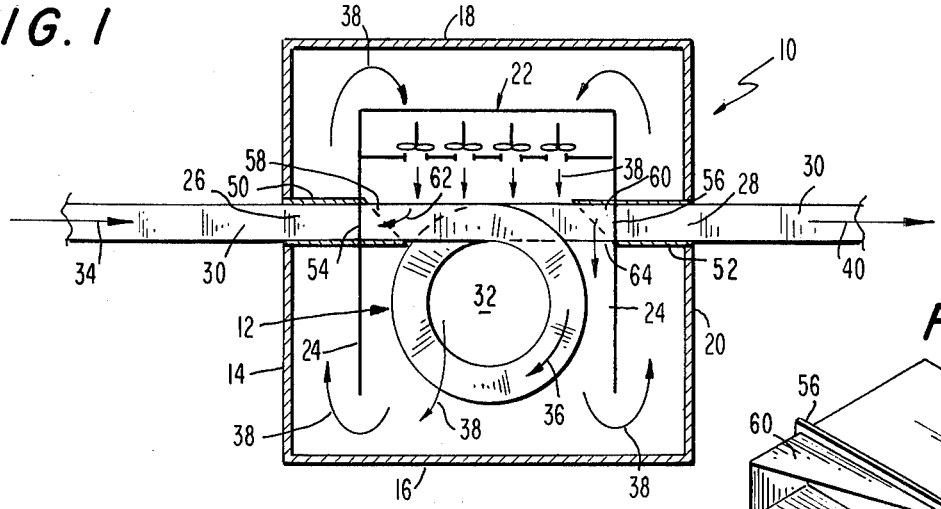
FIG. 2
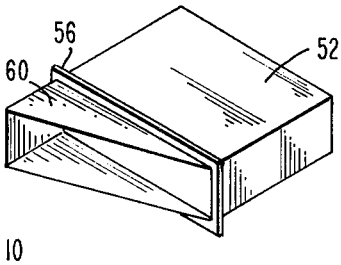
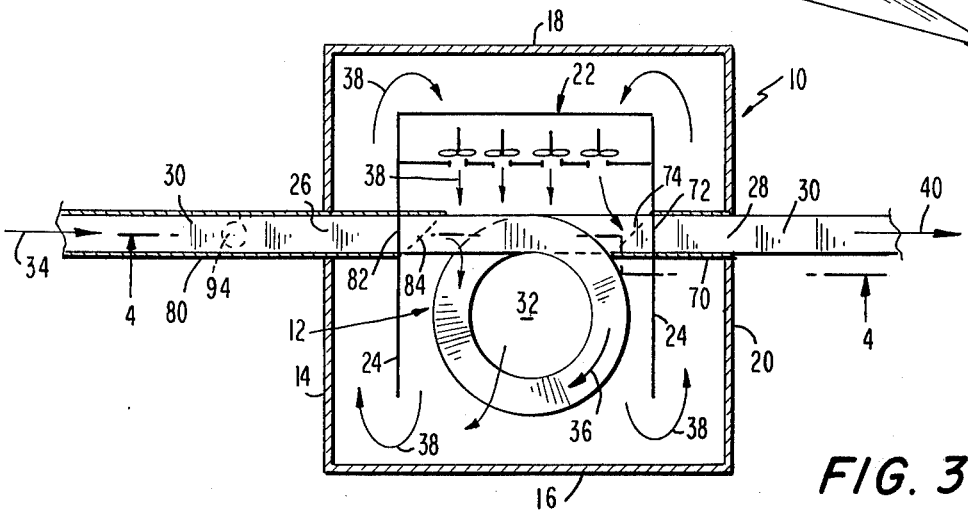
FIG. 3
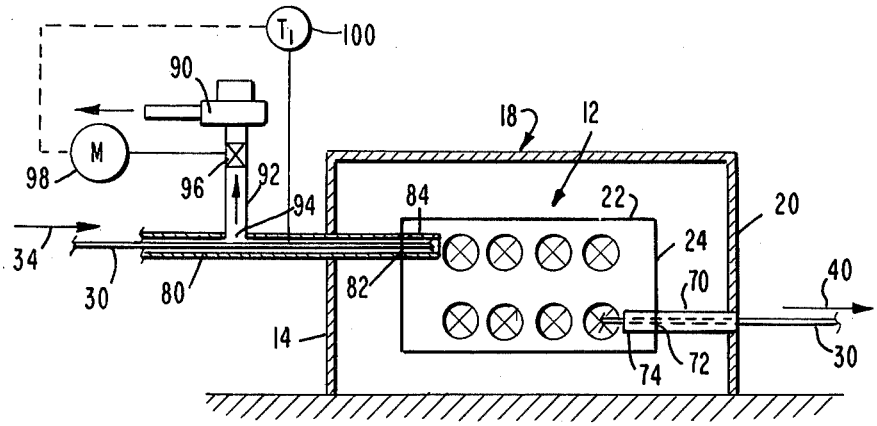
FIG. 4

FOOD PROCESSOR WITH AN AIR BALANCING SYSTEM

The invention relates to an improved commercial food processing plant and in particular, to a system for minimizing air flow into and out of a food blast freezer.

There is presently in wide-spread commercial use, food processing plants in which food products are prepared for subsequent retail sale. In one type of plant, the food is prepared by freezing in a blast freezing chamber by passing cold air produced by refrigerant evaporators past the food product while the food product is within the blast freezing chamber (hereinafter referred to as "freezing chamber"). The freezing chamber generally includes food entry and exit ports and a conveyor system which transports the food products from the entry port through the freezing chamber and out of the exit port.

One of the problems associated with the use of such a freezing system is ice accumulation on the evaporator coils and other parts of the freezing chamber which decreases the efficiency of operation of the freezing chamber by inhibiting the cold air flow through the evaporator coils. Removal of the ice is required to return the freezing chamber to normal operating conditions. In the past, ice was removed either during periodic discontinuance of production in the freezing chamber by electric defrosting or by the installation of special defrosting equipment to continuously prevent ice accumulation on the evaporator coils. Either alternative is very costly in a commercial operation of the type described and reduction or elimination of the problem is a much sought after result.

From observations of the operation of commercial freezing systems, I have determined that the ice accumulation in the freezing chamber is produced by the natural flow of a relatively warm humid air from the environment surrounding the freezing chamber through the food entry or exit port and into the interior of the freezing chamber. This natural flow of air appears to be induced by a static pressure difference outside of the entrance and exit ports respectively.

Accordingly, it is one of the objects of this invention to provide an improved commercial food processing plant which overcomes the aforementioned problems. It is a particular object of the invention to provide an air balancing system for the freezing chamber in such a plant to prevent outside air from entering the chamber so that the efficiency of operations is increased.

It is the specific object of the invention to provide an air balancing system for a freezing chamber to overcome the problem of frost accumulation therein associated with the use of such chamber.

Still further, it is an object of this invention to provide such a system which is low in cost and relatively easy to operate.

These and other objects of the invention are carried out in accordance with the invention by providing a freezing chamber with an air balancing system which substantially reduces the static air pressure difference between the entry and exit ports resulting in substantially reduced flow of air into and out of the chamber.

In accordance with one embodiment of the invention, the air balancing system includes ducts surrounding the conveyor system and extending into the freezing chamber from the entry and exit ports. Shrouds extend from the inner edges of the ducts inwardly into the freezing chamber and are cooperatively positioned with respect to the flow of cold air from the evaporator to induce a flow of air relative to the entry and exit ports in opposition to the natural flow of air which occurs without the air balancing system.

In another embodiment of the invention, in addition to the ducts and shrouds at the entry and exit port, an additional duct is provided surrounding the conveyor outside either the entry or exit port. An air blower is coupled through the external duct to communicate with the air inside the chamber. The air blower is operative to either exhaust air from the freezing chamber or provide air to the freezing chamber to further reduce the net air flow.

These and other objects and features of the invention will be more fully understood from the following detailed description when considered in connection with the accompanying drawings wherein several embodiments of the invention are illustrated by way of example and in which:

FIG. 1 is a diagramatic representation of a portion of a food processing plant showing a horizontal sectional representation of a freezing chamber having an air balancing system coupled to both the food product entry and exit ports arranged to provide substantially reduced air flow with respect to the freezing chamber;

FIG. 2 is an isometric representation increased in size of the air balancing system coupled to the food product exit port at the right in FIG. 1;

FIG. 3 is a horizontal sectional diagramatic representation of a freezing apparatus in accordance with the invention showing a second embodiment in which the air balancing system includes an exhaust blower at the food product entry duct on the left in combination with the shroud system within the chamber to further balance the air flow with respect to the chamber.

FIG. 4 is a vertical sectional view taken along line 4—4 in FIG. 3 and looking in the direction of the arrows and also showing in schematic form the exhaust blower and control therefor.

Referring now to FIG. 1, there is shown a schematic and diagramatic representation of a portion of a food processing plant utilized for freezing food products and incorporating features of the invention. The portion of the food processing plant, generally designated by reference numeral 10, includes freezing chamber 12 having suitably insulated side walls 14, 16, 18, and 20 and top and bottom walls (not shown). Mounted in the freezing chamber 12 is a refrigerant evaporator, generally designated by reference numeral 22 and baffles 24 extending generally parallel to walls 14 and 20 on opposite sides of evaporator 22 and parallel to the top and bottom walls. Side wall 14 is provided with a food entry port 26, and side wall 20 is provided with food exit port 28. An endless conveyor 30 is supported in a helical path 32 within the freezing chamber surrounded by baffles 24 and extends through both the entry port 26 and exit port 28 to provide a continuous supply of food products through freezing chamber 12. In operation of the freezing system just described, food products located on conveyor 30 are transported into the freezing chamber 12 through entry port 26 as represented by arrow 34. The food product is then conveyed downwardly in helical path 32, as represented by arrow 36. As the food product moves in helical path 32, cold air from evaporator 22 as represented by arrows 38, is blown across the food product. The baffles 24 direct the air over the food product with the required air velocity to efficiently and quickly freeze the food product. The refrigerated air returns to the evaporator through the space between the baffles and outer walls of the housing. The frozen food product is then conveyed out of the freezing chamber through exit port 28 as represented by arrow 40. As explained above, the difference in static air pressure outside the entrance and exit ports respectively produces air flow through the freezing chamber resulting in unwanted ice accumulation.

To overcome this problem, an air balancing system is provided for the freezing chamber. Referring now to FIGS. 1 and 2, the air balancing system includes entry port duct 50 and exit port duct 52 surrounding conveyor 30. The outer end of entry port duct 50 is mounted to side wall 14 surrounding the entry port 26 and extends inwardly to mounting flange 54 mounted on baffle 24. Similarly, the outer end of exit port duct 52 is mounted to side wall 20 surrounding the exit port 28 and extends inwardly to mounting flange 56 mounted on baffle 24. Extending from the inner ends of ducts 50 and 52 are shrouds 58, 60 respectively which as best seen in FIG. 2, are wedge-shaped. It has been determined that by positioning the open end of the shroud to intercept the air flow from the evaporator, such as shroud 58, that cold air is diverted toward the outside of the chamber as indicated by arrow 62. Orienting the shroud with the closed end facing the air flow, such as shroud 60, has the effect of drawing outside air into freezing chamber 12, as indicated by arrow 64.

The manner in which the air balancing system is positioned and oriented within the freezing chamber will now be described. Prior to mounting the air balancing system, the freezing chamber is operated and the air flow relative to the freezing chamber is determined. (This will be referred to as "the natural air flow.") This determination can be made by placing a standard thermometer in ducts 50 and 52 and measuring the temperature in these ducts. If warm air is entering either of the ports, the temperature will be relatively high, therein, approaching room temperature. If cold air is leaving the freezing chamber through either port, the temperature would be relatively low, approaching the temperature of the air in the chamber. Once the direction of the natural air flow has been established, the air balancing system is mounted with the shrouds oriented to provide a counter air flow producing a substantially reduced net flow of air through the freezing chamber.

For example, in the embodiment shown in FIG. 1, it was determined that without the air balancing system, air flowed into freezing chamber 12 through entry port 26 and out of freezing chamber 12 through exit port 28. Shroud 58 is oriented to produce air flow out of entry port 26 to balance the natural air flow into the freezing chamber through this port and shroud 60 is oriented to produce air flow into the freezing chamber through exit port 28 to balance the natural flow of air out of exit port 28. The dimensions of the shroud are dependant upon a number of factors including the size of the freezing chamber, the rate of cold air flow, the size of the entry and exit ports, etc. By adjusting the size of the shrouds, the amount of balancing air flow is changed until there is substantially reduced net air flow through chamber 12. This result is achieved when any change in the system at either port produces a shift in temperature therein. It is, of course, possible to produce air balance with a single shroud coupled to either the entry or exit port.

Referring now to FIGS. 3 and 4, there is shown another embodiment of the invention. Since many of the components in FIGS. 3 and 4 are the same as the components shown in FIGS. 1 and 2, they are designated with the same reference numerals. Thus, food processing apparatus 10 includes freezing chamber 12 having insulated side walls 14, 16, 18 and 20. Side walls 14 and 20 include food entry and exit ports 26 and 28 respectively. Conveyor 30 transports food products through food entry port 26 into the freezing chamber 12 and thereafter in helical path 36 where the food products are in contact with cold air flow repsented by arrows 38, produced by evaporator 22. While in the freezing chamber, the food products are frozen and after freezing, are transported through exit port 28 for further processing.

The air balancing system includes an exit port duct 70 surrounding conveyor 30. The outer end of exit port duct 70 is mounted to side wall 20 surrounding exit port 28 and extends into freezing chamber 12. Mounting flange 72 mounts duct 70 to baffle 24. Extending from the inner end of duct 70 is a wedge-shaped shroud 74 which is oriented and positioned in the freezing chamber to provide air balance as will be described in greater detail below.

The air balancing system also includes an entry port duct 80 which surrounds conveyor 30 and extends from a position outside freezing chamber 12 through entry port 26 and is mounted on baffle 24 by flange 82. Extending from the inner edge of duct 80 is a wedge-shaped shroud 84 which is oriented and positioned to provide air balance as will be described below. The air balancing system further includes an exhaust blower, 90 which is coupled to the interior of duct 80 and to the air in freezing chamber 12 by duct 92 which extends through an opening 94 in duct 80. Mounted in duct 92 is control valve 96 under the control of motor 98 to selectively open and close the air flow path through duct 92. A temperature transducer 100 communicates with the interior of duct 80 to provide an electrical control signal to motor 98 when the air in the duct reaches a pre-determined temperature.

To set up the air balancing system of FIGS. 3 and 4 for use with freezing chamber 12, the natural air flow is first determined as described above. Since exhaust blower 90 is operative to withdraw air from the interior of the duct, the shrouds 74, 84 are oriented and positioned to produce a net air flow in a predetermined direction which is opposite to the direction of the exhaust air flow. For example, in the freezing chamber of FIGS. 3 and 4, since exhaust blower 90 is operative to withdraw air from entry port 26, shrouds 84 and 74 are oriented to produce a net air flow into the freezing chamber through entry port 26 and out of entry port 28 which is subsequently balanced by the operation of exhaust blower 90 to produce substantially zero net air flow through entry port 26.

In operation of the air balancing system, temperature transducer 100 senses the temperature inside duct 80. When the temperature increases to a pre-determined level, for example, about 70°, indicating air flow into freezing chamber 12, a control signal is applied to motor 98 which adjusts valve 96 thereby exhausting a greater flow of air from the duct 80 to counter the flow of air into the chamber. When the temperature in the duct returns to, for example, zero, temperature transducer 100 applies an opposite control signal to motor 98 adjusting valve 96 to reduce the suction and thereby counter the flow of air from the chamber.

Of course, other configurations of the air balance system are possible. In a freezing chamber which does not utilize baffles 24, the shrouds may be mounted directly to the food product inlet and outlet ports to provide air balance. An exhaust blower could be used at the exit port, or two exhaust blowers could be utilized; one at the entry port, the other at the exit port. Air blowers to provide air into the ducts could be used in place of the exhaust blowers to balance the material air flow out of the freezing chamber. Valve 96 can also be manually adjusted as opposed to being automatically controlled to provide balance instead of using an automatic balance system. Furthermore, the air balancing system is not limited to use with a freezing chamber but is applicable to any food processing chamber in which it is desired or necessary to prevent the flow of outside air into the chamber. Still further, the shrouds need not be wedge-shaped but could have any shape which will accomplish the desired result. These and other modifications can be made without departing from the spirit or scope of the invention which is set forth in the claims.

What I claim is:

1. A system for blast freezing of food products comprising, a freezing chamber, food product entry and exit ports in said freezing chamber, food product conveying means extending through said entry port said freezing chamber and said exit port for conveying food products into through and out of said freezing chamber, means mounted in said freezing chamber for circulating refrigerated air over the food product as it is conveyed through said freezing chamber to freeze said food products, air balancing means coupled to at least one of said food entry or exit ports, said air balancing means including shroud means, means for coupling said shroud means to at least one of the food product entry or exit ports, said shroud means surrounding said conveyor means and extending at least partially into the flow path of said circulating refrigerated air in said freezing chamber, said shroud means positioned to intercept a determined part of the flow of refrigerated air inside the freezing chamber to produce an air flow condition in which there is a substantially reduced net flow of air into said freezing chamber and substantially reduced net flow of air into said freezing chamber and substantially reduced net flow of refrigerated air out of said freezing chamber.

2. The air balancing system of claim 1 wherein said shroud means is wedge-shaped having a diagonal open end positioned with respect to the flow of refrigerated air to substantially reduce net flow of warm humid air into said freezing chamber and simultaneously substantially reduce net flow of refrigerated air out of said freezing chamber.

3. The system of claim 1 wherein said means for coupling said shroud means to said at least one of the food product entry or exit ports includes duct means surrounding said conveyor having an outer end extending to at least the food product entry or exit ports and an inner end mounting said shroud in position in the freezing chamber relative to the flow of refrigerated air.

4. The system of claim 3 further including air exhausting means communicating with the interior of said at least one duct means cooperatively controlled with respect to the flow of ambient air into said freezing chamber to reduce the net flow of ambient air into said freezing chamber.

5. The system of claim 4 further including means communicating with the interior of said duct means to sense the direction of the air flow relative to said freezing chamber, said sensing means coupled in controlling relation to said air exhausting means to adjust said air exhausting means in response to the sensed flow of air to substantially reduce net air flow into said freezing chamber and substantially reduce net flow of refrigerated air out of said chamber.

6. The system of claim 5 wherein said sensing means includes a temperature probe positioned in said duct means for sensing the direction of air flow.

7. The system of claim 1 wherein said air balancing means further includes a second shroud means, means for coupling said second shroud means to the other of said food product entry or exit ports, said second shroud means positioned in said freezing chamber relative to the flow of refrigerated air and cooperatively arranged with respect to said first shroud means to substantially reduce net flow of air into said freezing chamber and substantially reduce net flow of refrigerated air out of said freezing chamber.

8. The air balancing system of claim 7 wherein said shroud means is wedge-shaped having a diagonal open end positioned with respect to the flow of refrigerated air to substantially reduce net flow of warm humid air into the freezing chamber and simultaneously substantially reduce net flow of refrigerated air out of said freezing chamber.

9. The system of claim 7 further including duct means surrounding said conveyor having outer ends extending to at least said food entry and exit ports respectively and having inner ends mounting said shrouds in position in the freezing chamber relative to the flow of refrigerated air.

10. The air balancing system of claim 9 further including air exhausting means coupled to said at least one of said duct means cooperatively controlled with respect to the flow of ambient air into said freezing chamber to reduce the net flow of ambient air into said freezing chamber.

11. An air balancing system for a food product blast freezing chamber including a housing, a food product entry and exit port in said housing, food product conveying means extending through said entry port said freezing chamber and said exit port for conveying food products into, through the and out of said freezing chamber, means mounted in the chamber for circulating refrigerated air over the food product as it is conveyed through said chamber to freeze said food products, said air balancing system including first and second duct means surrounding said conveyor, said first and second duct means each having an outer end communicating with said food entry or exit ports respectively, and shroud means mounted to the inner end of said duct means cooperatively arranged with respect to each other and positioned within the freezing chamber and each at least partially intercepting the flow of refrigerated air inside the freezing chamber to induce an air flow condition inside the duct means in which there is substantially reduced net flow of refrigerated air out of the chamber.

12. The air balancing system of claim 1 wherein said air exhausting means includes an air exhaust blower, means coupling said air exhaust blower to said at least one duct means and an adjustable valve member mounted in said coupling means for varying the amount of air exhausted by said air exhaust blower.

13. The air balancing system of claim 12 further including an exhaust duct coupling said air exhausting means to said at least one duct, control means including a valve member mounted in said exhaust duct, and sensing means coupled to the interior of said duct means adapted to sense the direction of air flow said control means being responsive to said control signal for adjusting said valve member to vary this amount of air flowing through said exhaust duct.

14. The air balancing system of claim 13 wherein said air flow sensing means is a temperature sensing probe.

* * * * *